US006494273B1

(12) United States Patent
Martin

(10) Patent No.: US 6,494,273 B1
(45) Date of Patent: Dec. 17, 2002

(54) ELEVATOR FOR SUPPORTING AN ELONGATE MEMBER SUCH AS A DRILL PIPE

(76) Inventor: Richard Martin, Loddington Oast, Linton, Maidstone ME17 4AG (GB)

( * ) Notice: Subject to any disclaimer, the term of this patent is extended or adjusted under 35 U.S.C. 154(b) by 0 days.

(21) Appl. No.: 09/700,090

(22) PCT Filed: May 12, 1999

(86) PCT No.: PCT/GB99/01501

§ 371 (c)(1),
(2), (4) Date: Nov. 10, 2000

(87) PCT Pub. No.: WO99/58811

PCT Pub. Date: Nov. 18, 1999

(30) Foreign Application Priority Data

May 12, 1998 (GB) ..... 9810017

(51) Int. Cl.[7] ..... E21B 19/00

(52) U.S. Cl. ..... 175/220; 175/256; 166/77.1; 248/49

(58) Field of Search ..... 175/52, 113, 202, 175/220, 256, 257; 166/75.11, 77.1, 77.51, 77.52, 85.5; 248/49

(56) References Cited

U.S. PATENT DOCUMENTS

| | | | | |
|---|---|---|---|---|
| 1,385,435 A | | 7/1921 | Dunn | |
| 1,750,822 A | | 3/1930 | Spalding | |
| 1,967,517 A | | 7/1934 | Rogers | 255/1 |
| 2,048,209 A | | 7/1936 | Young et al. | 26/263 |
| 3,358,341 A | | 12/1967 | Burstall | 26/263 |
| 3,454,297 A | | 7/1969 | Turner, Jr. | 294/90 |
| 3,795,326 A | | 3/1974 | Neilon et al. | 214/2.5 |
| 3,913,687 A | * | 10/1975 | Gyongyosi et al. | 175/85 |
| 4,040,524 A | * | 8/1977 | Lamb et al. | 214/2.5 |
| 4,082,193 A | | 4/1978 | Teague | 214/2.5 |
| 4,209,066 A | | 6/1980 | Watson | 166/315 |
| 4,235,566 A | * | 11/1980 | Beeman et al. | 414/22 |
| 4,610,315 A | * | 9/1986 | Koga et al. | 175/85 |
| 4,800,968 A | * | 1/1989 | Shaw et al. | 175/85 |
| 4,832,552 A | | 5/1989 | Skelly | 414/22.54 |
| 5,732,909 A | * | 3/1998 | Sonnier | 248/49 |
| 5,992,801 A | * | 11/1999 | Torres | 248/49 |
| 6,237,684 B1 | * | 5/2001 | Bouligny, Jr. et al. | 166/77.52 |

OTHER PUBLICATIONS

International Search Report GB 99/01501 Sep. 22, 1999.

* cited by examiner

*Primary Examiner*—Frank Tsay
(74) *Attorney, Agent, or Firm*—Gifford, Krass, Groh, Sprinkle, Anderson & Citkowski, P.C.

(57) ABSTRACT

The present invention relates to an elevator (10, 134, 136, 150, 162, 186), particularly a single joint elevator, for supporting tubular members such as drill pipe (118), borehole casing and/or production tubing, for use in downhole operations. In a preferred embodiment of the invention, an elevator (10) is generally elliptical shaped, and comprises a housing (12), a lock (14), lifting eyes (16) and a hinge (18). The housing comprises first and second portions (20, 22), pivotally coupled via the hinge (18), which together define an upper ring, elliptical in cross-section, and a tapering, generally truncated cone-shaped lower portion. The tapered lower portion of the elevator (10) ensures that the elevator (10) does not become caught or fouled upon a Vee door, or a pipe discharge ramp (122), on to which the pipe (118) supported by the elevator (10) is to be discharged during, for example, the "running-in" of the pipe (118) into a borehole of an onshore or offshore well.

40 Claims, 8 Drawing Sheets

ELEVATOR FOR SUPPORTING AN ELONGATE MEMBER SUCH AS A DRILL PIPE

The present invention relates to an elevator. In particular, but not exclusively, the present invention relates to a single joint elevator for supporting tubular members for use in downhole operations.

Presently known single joint elevators are used for raising lengths of drill pipe, borehole casing or production tubing from a pipe stand rack in a derrick, or a pipe storage area on the main deck of an onshore or offshore oil rig, or from a "mouse hole" in the drilling floor, and for locating the drill pipe (or the borehole casing or production tubing) at the upper end of a drill pipe string protruding through a kelly in the drill floor. The single joint elevator is typically suspended from a hoist wire or winch mounted on the derrick. In addition to their use in making up drill string, single joint elevators are also utilised when "tripping out", that is retrieving a drill string from a borehole. Typically, when removed from the drill string, each section or stand of drill pipe is pushed out of a Vee door on to a catwalk adjacent to the pipe storage area via a pipe discharge ramp, for subsequent pick up by a crane. Such ramps comprise an inclined surface upon which the drill pie is laid, using the single joint elevator, and subsequently released, discharging from the ramp below drill floor deck level.

The structure of existing single joint elevators is such that the elevators often include sharp, angular, or protruding profiles which may catch on the upper end of the ramp. This may result in the single joint elevator carrying the drill pipe section fouling on the ramp, or "bouncing" from the ramp when the elevator becomes unstuck, creating a potential hazard to operators present or. the drilling floor. Also, the single joint elevators include latches and securing mechanisms for locking the elevator to the pipe section. Due to the structure of single joint elevators, the orientation of the clamp with respect to the pipe ramp is not predetermined and, consequently, it has been known for the clamp to unlock by fouling on the pipe ramp, causing the pipe section to be released prematurely.

It is amongst the objects of the present invention to is obviate or mitigate at least one of the foregoing disadvantages.

Accordingly, the present invention provides an elevator for supporting an elongate member, the elevator comprising a housing having retaining means for retaining the elongate member, and an Inclined outer surface.

References herein and in the following description to elevators are generally to single joint elevators. However, as will be understood by persons skilled in the art, the present invention is not limited to single joint elevators, and applies equally to other types of elevators. Furthermore, references herein and in the following description to a drill pipe, or to a section or stand of drill pipe, are to drill pipes, borehole casings and/or production tubing, or to a section or stand of such drill pipes, borehole casing and/or production tubing.

Thus the present invention may provide an elevator having an inclined outer surface which may prevent the elevator from becoming caught upon a fee door, discharge ramp, or any projecting or angular surface for discharging the elongate member.

The elongate member may be a tubular member such as a section or stand of drill pope. The pipe may be for use in downhole oilfield operations. Conveniently, the elevator may be for supporting the pipe during "tripping out" or removal thereof from a borehole and/or during removal thereof from a mouse hole adjacent to the borehole. The elevator may also be for supporting the pipe during run-in thereof into the borehole.

Preferably, the housing comprises a ring defining a throughbore. The ring may comprise two sections which together form the ring, and a hinge coupling the two sections together, for allowing the ring to open and close. The hinge may be a single or double hinge. The ring may be generally elliptical, oval, or circular in plan view and may include lifting eyes, as will be discussed in more detail below, or alternative projections For lifting or other uses. The ring may further comprise an outer wall forming a boundary of the ring, an upper plate extending radially inwardly from the outer wall and defining an upper opening, and a lower plate extending radially inwardly and defining a lower opening. The retaining means may comprise an inner wall of the ring, defining an abuttment surface for abutting the elongate member. The upper opening of the ring may be inclined or square in cross-section to suit differing profiles of drill pipe, borehole casing and/or production tubing. The upper opening may define the abuttment surface. The inclined abuttment surface of the upper opening may be adapted to abut a collar of a section of drill pipe.

Preferably the upper and lower openings are circular in cross-section, and offset from the longitudinal axis of the housing. Thus the present invention may allow the elevator, when supporting the elongate member, to be disposed inclined from the vertical to facilitate discharge of the elongate member on the discharge ramp.

Preferably the inclined outer surface of the elevator is provided on a lower portion thereof. The outer surface may be of a metal or an elastomeric material. The lower portion of the elevator may comprise a truncated cone, projecting downwardly from the housing, and tapering from the housing to an opening. The opening of the cone may define an abuttment surface for abutting or guiding the elongate member.

Alternatively, the inclined outer surface of the elevator may be formed peripherally on the elevator. An outer wall of the housing may comprise the inclined outer surface of the elevator.

In a further alternative, the inclined surface may comprise an inclined plate, wedge or the like, projecting downwardly from the housing, or formed peripherally on the elevator.

Preferably, the elevator further comprises locking means for releasably locking the housing to retain an elongate member therein. Thus the present invention may allow the housing to be locked to securely support the elongate member. The locking means may comprise a latch arm formed on a first half of the housing, and a catch formed on the second half of the housing. The latch arm may be spring loaded. The catch may include a spring loaded cover to releasably retain the latch arm to the catch.

Preferably, the elevator further comprises support means for supporting the housing. The support means may further comprise one or more lifting eyes provided on the housing for coupling to hoisting means. Preferably the hoisting means comprises wire rope slings and a swivel block. Alternatively, the hoisting means may comprise a cable, chain, link, arm or the like coupled to a crane, a lifting pulley and winch assembly, or the like. The lifting eyes may be disposed proximal to a lock side of the elevator. The elevator may further comprise an insert for coupling to the elongate member enabling the elevator to support elongate members of various cross-sectional dimensions. The insert may be tubular, for coupling to the pine. A number of inserts of various cross-sectional dimensions may be provided.

Embodiments of the invention will be described, by way of example, with reference to the accompanying drawings, in which.

Figure 1:
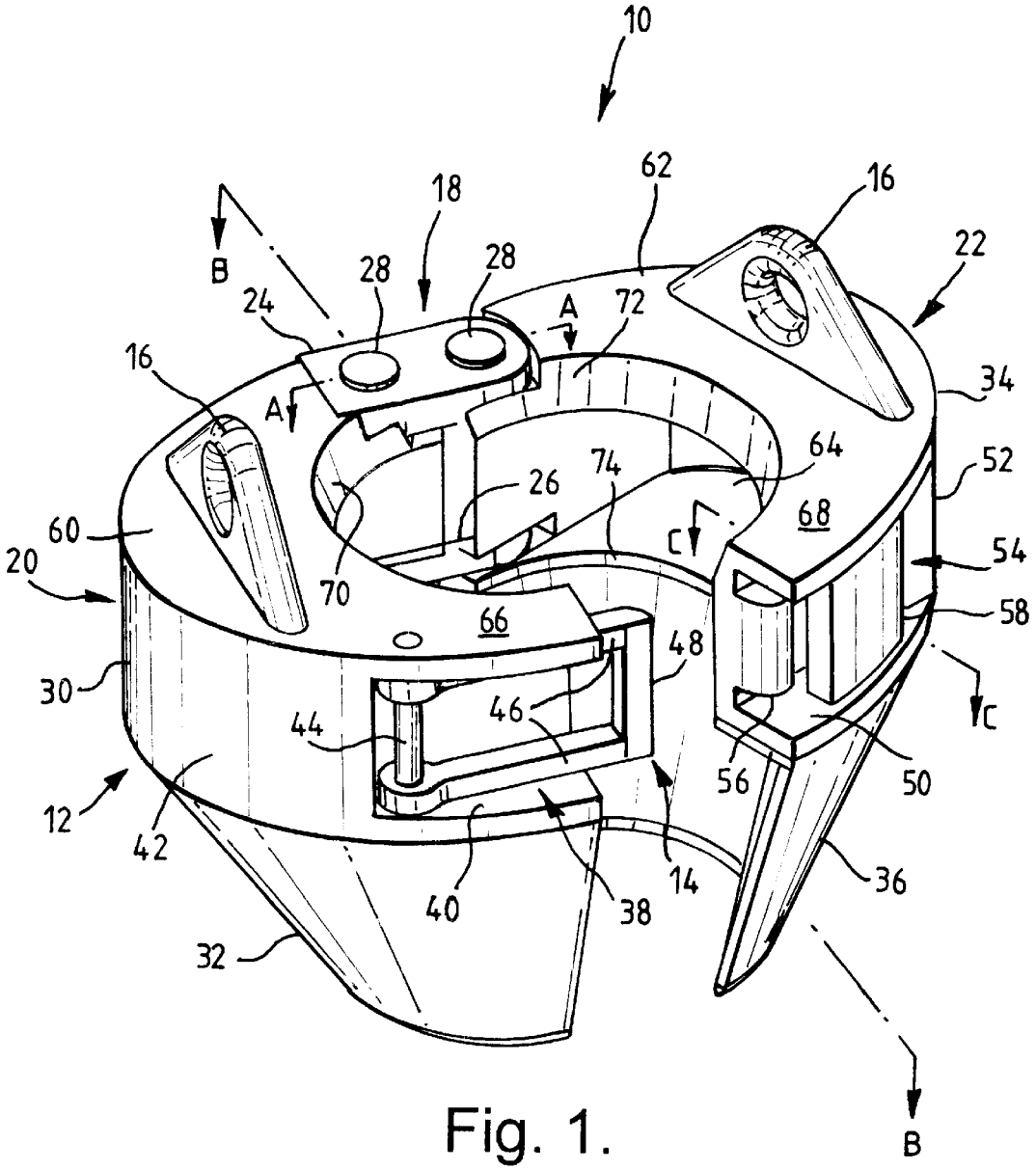
FIG. 1 is a perspective view of a single joint elevator in accordance with an embodiment of the present invention.

Referring firstly to FIG. 1, there is shown a generally elliptical shaped single joint elevator for supporting elongate tubular members such as drill pipe, borehole casings, or production tubing sections used in downhole oilfield operations (not shown in FIG. 1), indicated generally by reference numeral 10. The elevator 10 is constructed either from a relatively lightweight aluminium alloy, having outer strips of a stainless steel material in high wear locations; or from a steel, for heavy-duty usage. The aluminium alloy elevator has a weight (for a typical elevator designed to support a length of 5½ inch drill pipe) of 35 lbs, and is capable of supporting a load in the region of 3 tons. The steel elevator has good corrosion and impact resistances, a weight of 70 lbs, and is capable of supporting a load in the region of D tons. The elliptical shape of the elevator 10 eliminates roll of the elevator 10 on the rig deck and, as will be described in more detail below, the elevator 10 is substantially hollow, reducing weight.

The elevator 10 comprises a housing 12, a lock 14, lifting eyes 16 and a hinge 18. The housing 12 comprises a first portion 20, coupled to a second portion 22 via the hinge 18. The hinge 18 comprises upper and lower hinge plates 24 and 26 respectively, and hinge pins 28. This allows the first and second portions 20 and 22 to hinge about each other, and to open and close, as shown an FIG. 1. The first portion 20 of the housing 12 comprises a half ring 30 and tapering lower portion 32 extending downwardly from the half ring 30. Likewise, the second portion 22 of the housing 12 comprises a half ring 34 and a lower tapering portion 36. Together, when in a closed configuration, the first and second portions 20 and 22 of the housing 12 form an upper ring which is elliptical in cross-section and comprises the half rings 30 and 34, and a tapering, generally truncated cone-shaped lower portion comprising the lower tapering portions 32 and 36.

The lock 14 has a spring-loaded latch arm 38, coupled to the first portion 20 of the housing 12, in a recess 40 formed in the outer wall 42 of the half ring 30, via a latch pin 44. The latch arm 38 comprises first and second latch fingers 46, rotatably mounted to the latch pin 44, and a bevelled catch 48. The second portion 22 of the housing 12 includes a recess 50, formed in the outer wall 52 of the half ring 34, in which a spring loaded catch 54 is located. The catch 54 is shown in more detail in FIGS. 4A, 5 and 6, and includes a latch 56, which is engaged by the bevelled catch 48 of the latch arm 38 when the first and second portions 20 and 22 of the housing 12 are closed. The catch 54 also Includes a spring loaded slider 58, for retaining the latch arm 38 to the catch 54, as will be described in more detail below.

The half rings 30 and 34 of the housing 12 include upper members 60 and 62, which together define an annular elliptical plate when the housing 12 is closed. Likewise, the half rings 30 and 34 include lower members, only one of which is shown and given the reference numeral 64, which together form a similar annular elliptical plate when the housing 12 is closed. The upper members 60 and 62 have upper faces 66 and 68 respectively, on which the lifting eyes 16 are formed, enabling the elevator to be supported by lifting apparatus such as a crane hoist (not shown). Also, the upper members 60 and 62 define engaging surfaces 70 and 72, which are inclined at 18° from the vertical, for engaging a collar of the tubing or casing to be supported by the elevator. In a similar manner, the lower member 64 defines a planar engaging surface 74, for abutting and/or guiding the tubing or casing.

Figure 2A:
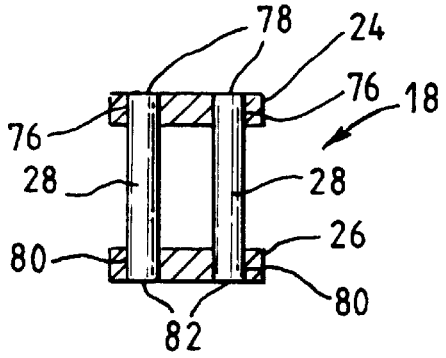
FIG. 2A is a cross-sectional view of hinge plates and hinge pins forming part of the elevator of FIG. 1, taken along line A—A.
Figure 2B:
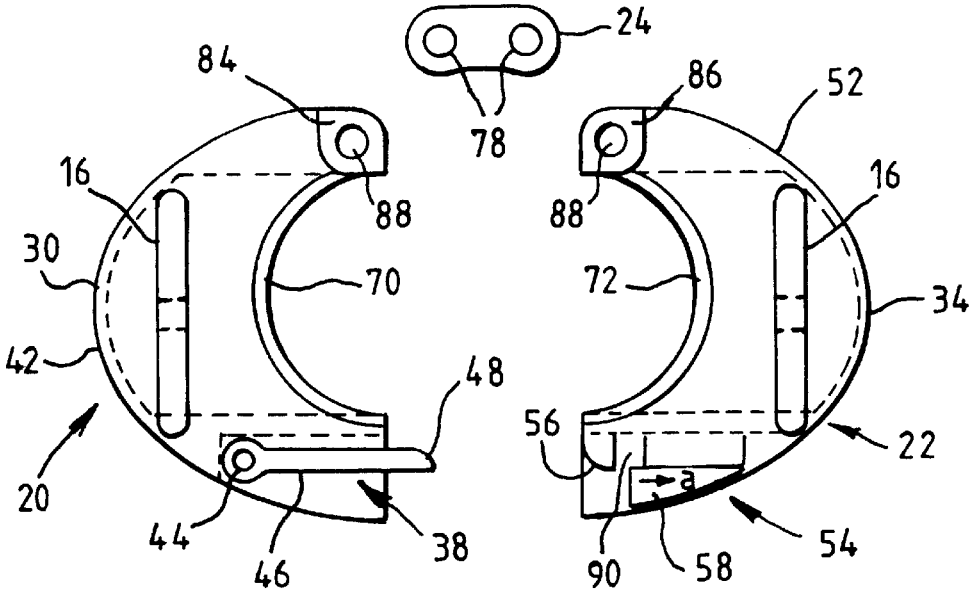
FIG. 2B is a partially exploded plan view of the elevator of FIG. 1.
Figure 3:
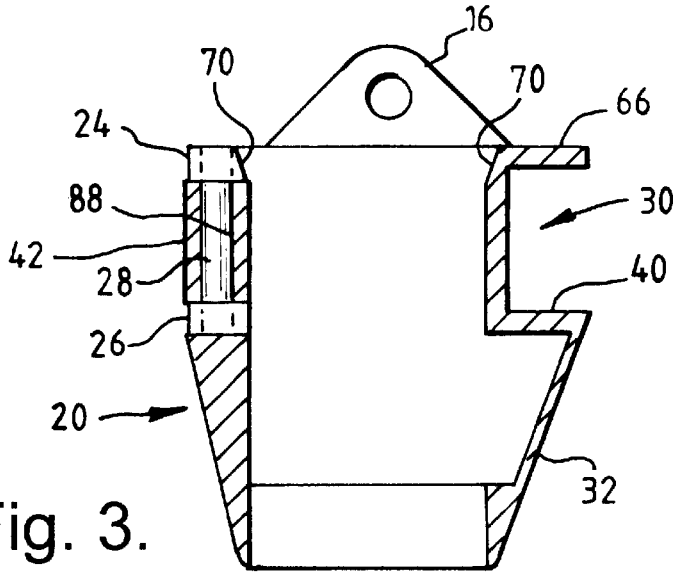
FIG. 3 is a cross-sectional side view of the elevator of FIG. 1, taken along line B—B, and shown with a latch arm of the elevator removed for clarity.

Referring now to FIGS. 2A and 2B, the lock 14 and hinge 18 of the elevator 10 of FIG. 1 are shown in more detail. FIG. 2A is a cross-sectional view of hinge 18 taken along line A—A in FIG. 1, and shows the upper hinge plate 24, lower hinge plate 26, and the hinge pins 28. The upper ends 76 of the pins 28 are disposed in holes 78 of the upper plate 24, and the lower ends 80 are disposed in holes 82 of the lower plate 26. The upper plate 24 resides in recesses 84 and 86 n the half rings 30 and 34 so the housing 12, and the lower hinge plate 26 resides in similar recesses (not shown). The hinge pins 28 couple the first and second portions 20 and 22 of the housing 12 together, and are disposed in passageways in each of the half rings 30 and 34. One such passageway 88 in the half ring 30 is shown in FIG. 3. When the elevator 10 is assembled as shown in FIG. 1, and moved to the closed configuration, the spring-loaded latch arm 38 pivots about the latch pin 44, and the catch 48 moves over the surface of the latch 56. This displaces the spring loaded slider 58 laterally in the direction of the arrow shown in FIG. 2B, and the catch 48 is engaged in a latch recess 90. The slider 58 then returns, under the force of the spring (not shown in FIG. 2B), to retain the latch arm 38 in the engaged position, thereby locking the housing 12 in the closed configuration.

Figure 4A:
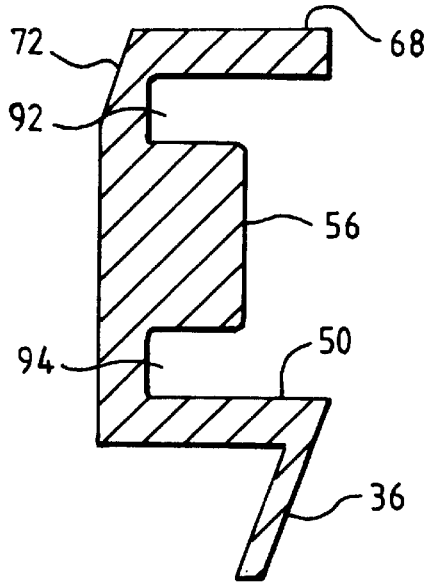
FIG. 4A is a cross-sectional view of a latch forming part of the elevator of FIG. 1, taken along line C—C.
Figure 4B:
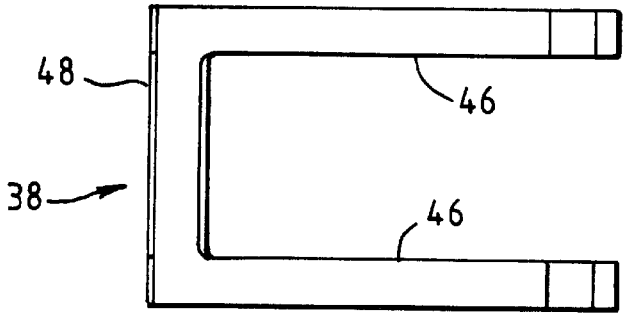
FIGS. 4B to 4D are rear, plan and partial plan views of a latch arm forming part of the elevator of FIG. 1.
Figure 4C:
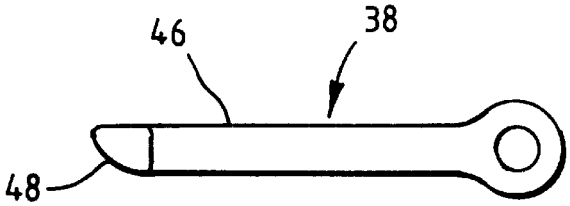
Figure 4D:
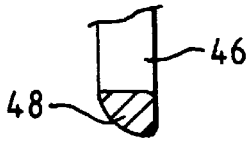

Referring now to FIG. 4A, which is a cross-sectional view of a portion of the elevator 10, taken along line C—C of FIG. 1, there is shown the latch 56, which engages the bevelled catch 48 of the latch arm 38. The catch 56 defines latch finger engaging recesses 92 and 94, which engage the latch fingers 46 of the latch arm 38 when the housing 12 is in the closed configuration, with the catch 48 disposed in latch recess 90. FIG. 4B is a rear view of the latch arm 38, and FIGS. 4C and 4D illustrate the bevelled catch 48 in more detail.

Figure 5:
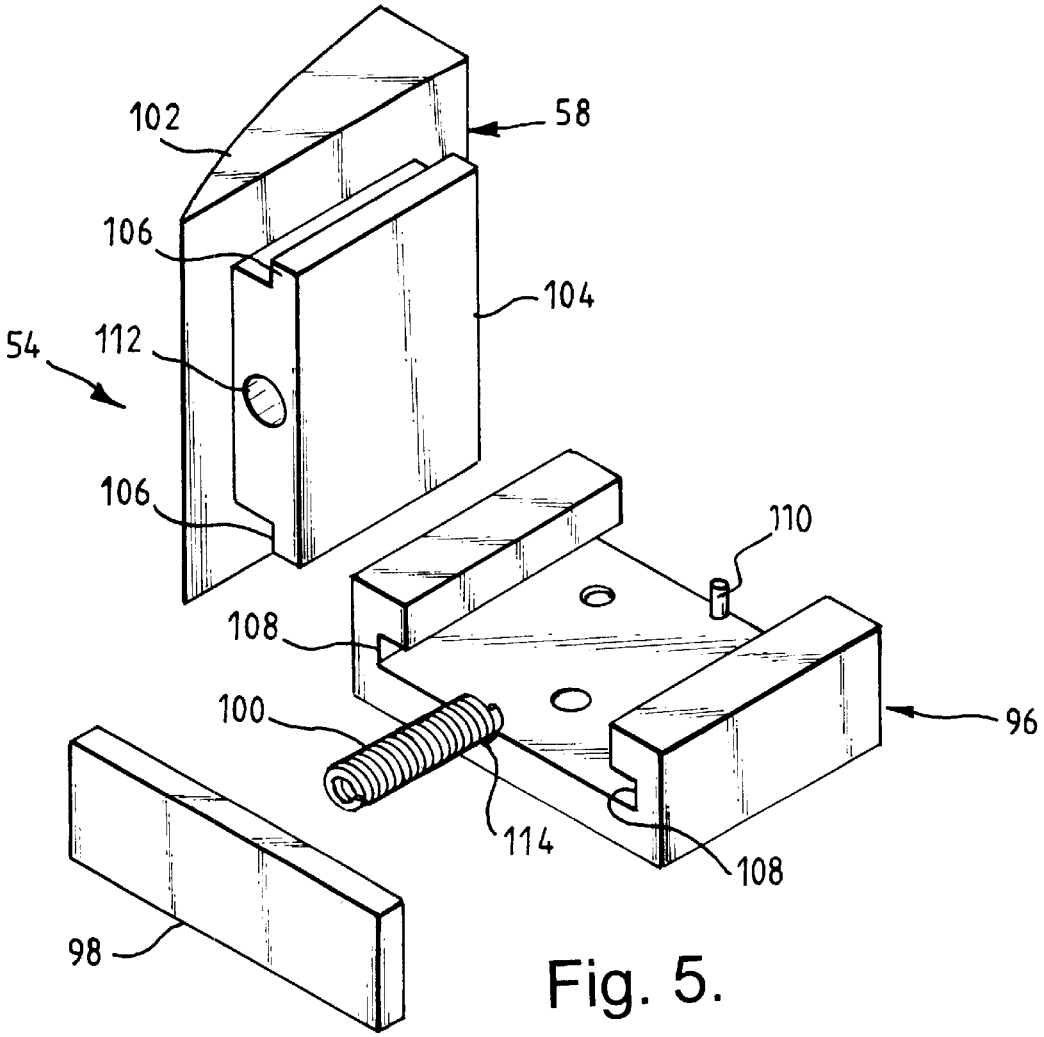
FIG. 5 is an exploded perspective view of a catch forming part of a lock of the elevator of FIG. 1.
Figure 6:
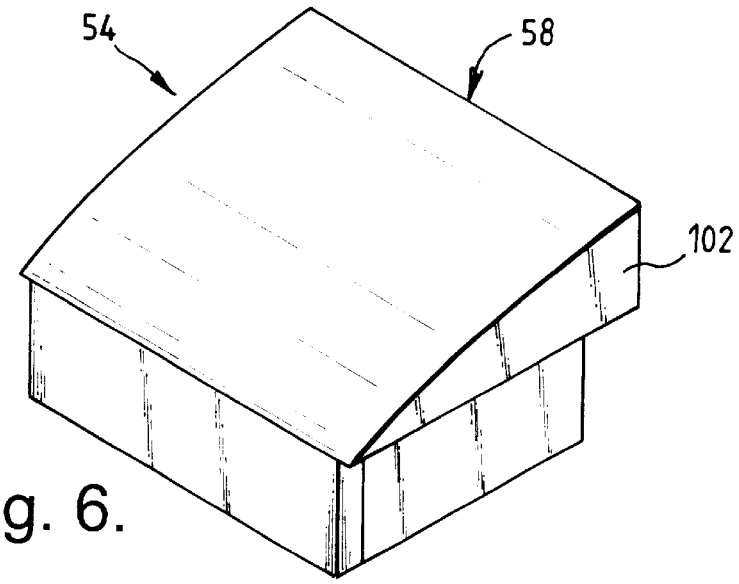
FIG. 6 is a perspective view of the catch of FIG. 5, shown in an assembled configuration.

Turning now to FIG. 5, there is shown an exploded perspective view of the spring loaded catch 54. The catch 54 comprises a generally U-shaped base unit 96, a retaining plate 98, a compression spring 100 and the slider 58. The slider 58 comprises an upper, arcuate lid 102 and an engaging plate 104 having tongues 106 for engaging grooves 108 in the base unit 96. The base unit 96 includes a retaining pin 110 for stopping the travel of the slider 58 along the base unit 96. Furthermore, the engaging plate 104 of the slider 58 includes a spring engaging depression 112, in which an end 114 of the spring 100 is engaged when the slider 58 is located in the base unit 96. The retaining plate 98 is then coupled to the base unit 96, typically by welding the plate 98 to the base unit 96, to retain the slider 58 in the base unit 96. Thus the slider 58 may be moved along the base unit 96 in the direction of the arrow shown in FIG. 2B, by compression of the spring 100 between the depression 112 and the retaining plate 98. This enables the catch 48 of latch arm 38 to be removed from the latch recess 90, allowing the elevator 10 to be opened to the position shown in FIG. 1. The assembled catch 54 is shown in FIG. 6.

There follows a description of the operation of the elevator 10 in use, when used to support drill pipe sections removed from a borehole.

Figure 7:
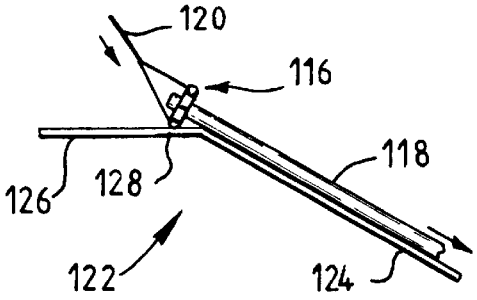
FIG. 7 is a schematic side view of a conventional elevator, shown discharging a drill pipe section onto a pipe ramp.

Referring to FIG. 7, there is shown a conventional elevator 116 supporting a length of pipe 118, the elevator coupled to a hoist (not shown) via a hoist cable 120. The pipe 118 has been removed from a borehole by uncoupling the pipe 118 from the upper end of a drill string (not shown, coupling the elevator 116 to the pipe 118, raising the pipe 118 and transferring it to a pipe ramp 122 where it is to be discharged. The pipe ramp 122 comprises an inclined portion 124, and a flat upper portion 126. The flat upper portion 126 is provided at the drill floor level, with a Vee door (not shown) opening on to the ramp 122. The structure of the conventional elevator 116 is such that the elevator tends to become caught upon the ramp 122 at the point 128 or on the Vee door, often causing the pipe 118 to foul, or to bounce dangerously should the elevator 116 become freed during lifting operations. This may also cause the lock (not shown) of the elevator 116 to release, which may cause the pipe 118 to be discharged prematurely. This is particularly due to the fact that the conventional elevator 116 supports the pipe 118 in a substantially vertical disposition when the pipe 118 is raised. Thus the orientation of the lock with respect to the ramp 122 is not predetermined, and often the lock is disposed adjacent to the ramp 122 or Vee door when the pipe is lowered onto the ramp.

Figure 8:
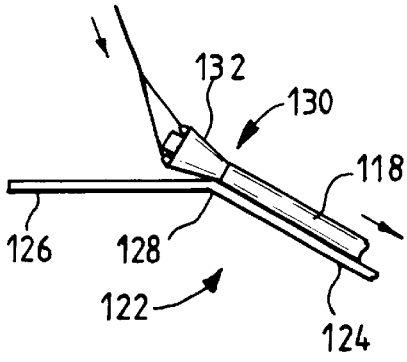
FIG. 8 is a schematic side view of an elevator in accordance with an alternative embodiment of the present invention, shown discharging a drill pipe section onto the pipe ramp of FIG. 7.

Referring now co FIG. 8, there is shown an elevator 130, similar to the elevator 10 of FIG. 1. The elevator 130 has tapered sides 132 similar to the tapered portions 32 and 36 of the elevator 10, which ensure that the pipe section 118 supported by the elevator 130 does not become caught or fouled on the Vee door or at the point 128 of the pipe ramp 122. The pipe 118 can thus be safely discharged along the discharge ramp 122 for removal and storage, by opening the lock (not shown) of the elevator 130 when desired.

As will be appreciated by persons skilled in the art, the elevator 10 of FIG. 1 facilitates the discharge of pipe such as the pipe section 118, as the engaging surfaces 70, 72 and 74 of the elevator 10 are offset from the longitudinal axis of the elevator, such that when the pipe 118 is supported by the elevator 10, the pipe 118 and elevator 10 are disposed inclined at an angle to he vertical. In this configuration, the lock 14 is disposed safely away from the Vee door and discharge ramp 122, and thus cannot be opened prematurely by catching or fouling on the ramp 122. Furthermore, the lower tapered portions 32 and 36 ensure smooth passage of the elevator 10 along the ramp 122.

Figure 9:
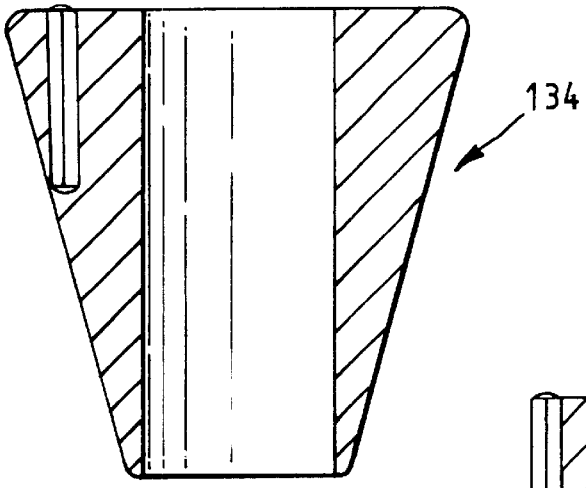
FIGS. 9 and 10 are cross-sectional views of elevators in accordance with further alternative embodiments of the present invention.
Figure 10:
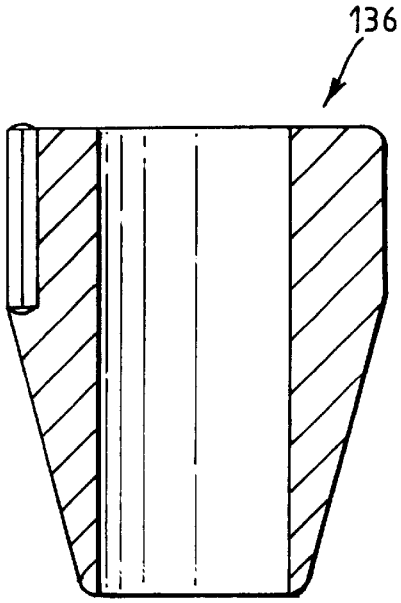

FIGS. 9 and 10 are cross-sectional views of alternative elevators 134 and 135, in accordance with alternative embodiments of the present invention, and showing alternative constructions of the elevator.

Figure 11:
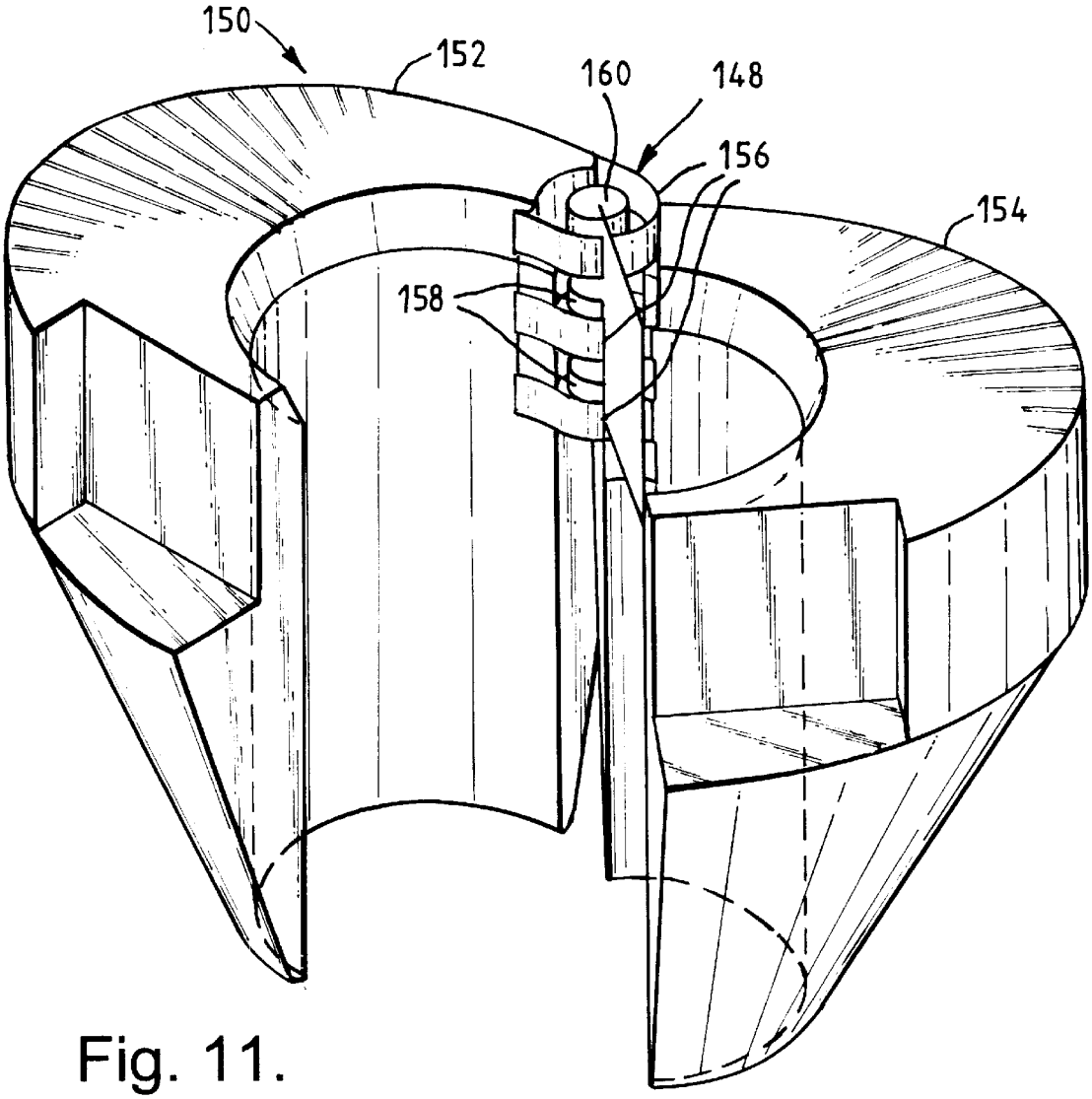
FIG. 11 is a perspective view of an elevator in accordance with a still further alternative embodiment of the present invention, shown in an open configuration and with a lock and lifting eyes of the elevator removed for clarity.

Referring now to FIG. 11, there is shown a perspective view of a further alternative elevator 150, in accordance with a yet further alternative embodiment of the present invention, and incorporating an alternative hinge 148. The elevator 150 comprises first and second portions 152 and 154, which are coupled together via the hinge 148. The hinge 148 comprises a number of intermeshing collars, first ones 156 of which are formed on the first portion 152, and second ones 158 of which are formed on the second portion 154. Each of the collars 156 and 158 include a passage 160 through which a hinge pin (not shown) may pass to couple the first and second portions 152 and 154 together.

Figure 12:
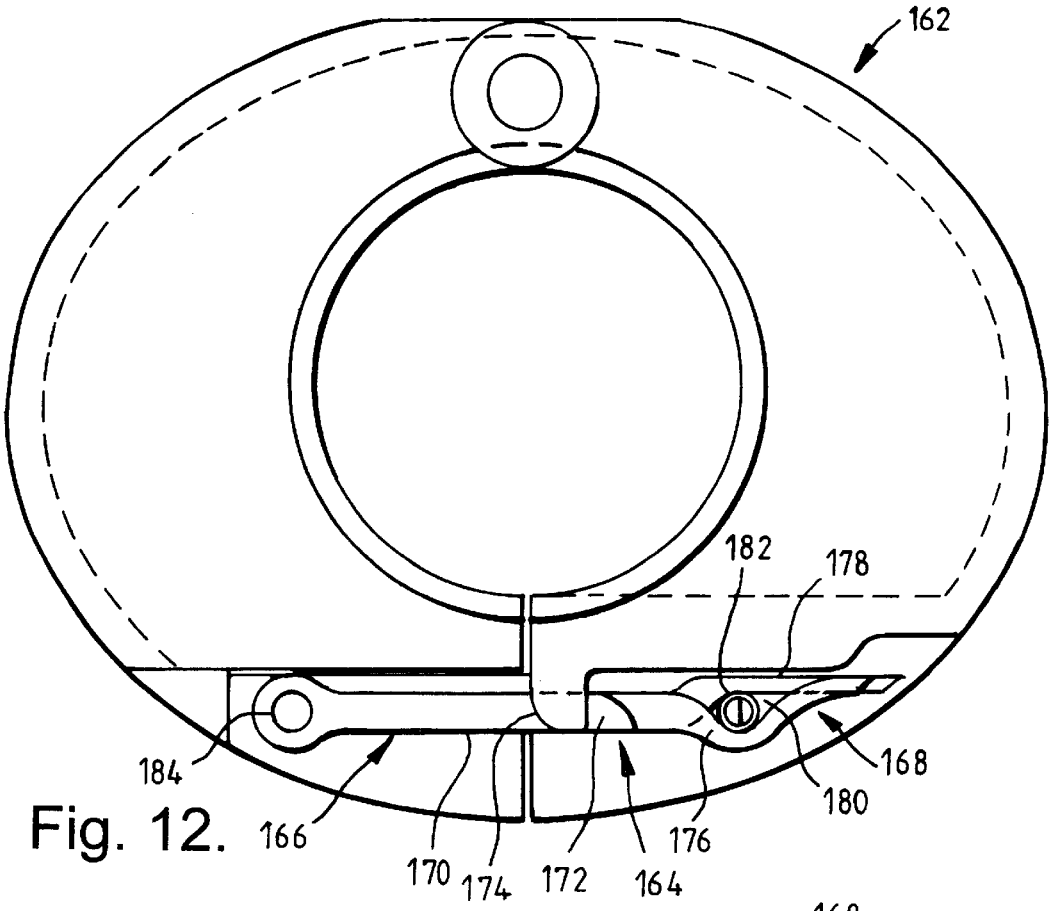
FIG. 12 is a plan view of an elevator in accordance with a still further alternative embodiment of the present invention, incorporating an alternative lock, and shown in a closed configuration.
Figure 13A:
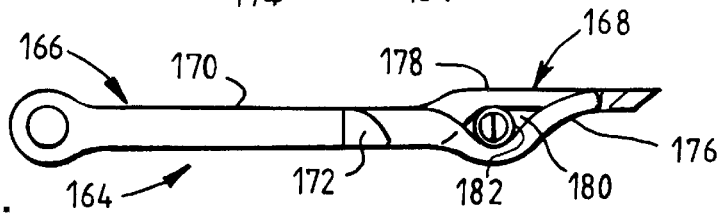
FIGS. 13A and 13B are clan and front views respectively of part of the lock shown in FIG. 12.
Figure 13B:
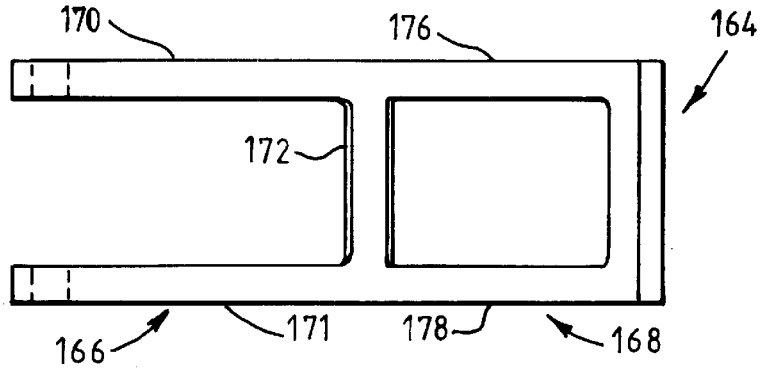

Referring now to FIG. 12, there is shown a plan view of another alternative elevator 162, in accordance with a still further embodiment of the present invention, having a double-latching lock 164. The lock 164 is shown in more detail in the Plan and front views of the lock 164 shown in FIGS. 13A and 13B. The lock 164 comprises a first latch portion 166, and a second latch portion 168. The first latch portion 166 is similar in structure to the lock 14 of the elevator 10 shown in FIG. 1, and comprises latch fingers 170 and 171, and a bevelled catch 172, for engaging a latch 174 of the elevator 162. The second latch portion 168 comprises latch post engaging fingers 176 and 178, which extend from the fingers 170 and 171, and together define a channel 180 for receiving a latch post 182. The lock 164 is spring loaded and coupled to the elevator 162 via a latch pin 184, to pivot about the latch pin 184 and lock the elevator 162 in the closed configuration shown in FIG. 12. In this position, the catch 172 engages the latch 174, and the larch post 182 is located in the channel 180, and disposed in a mounting hole (not shown) in elevator 152. This provides the double latching of the elevator 162.

Figure 14:
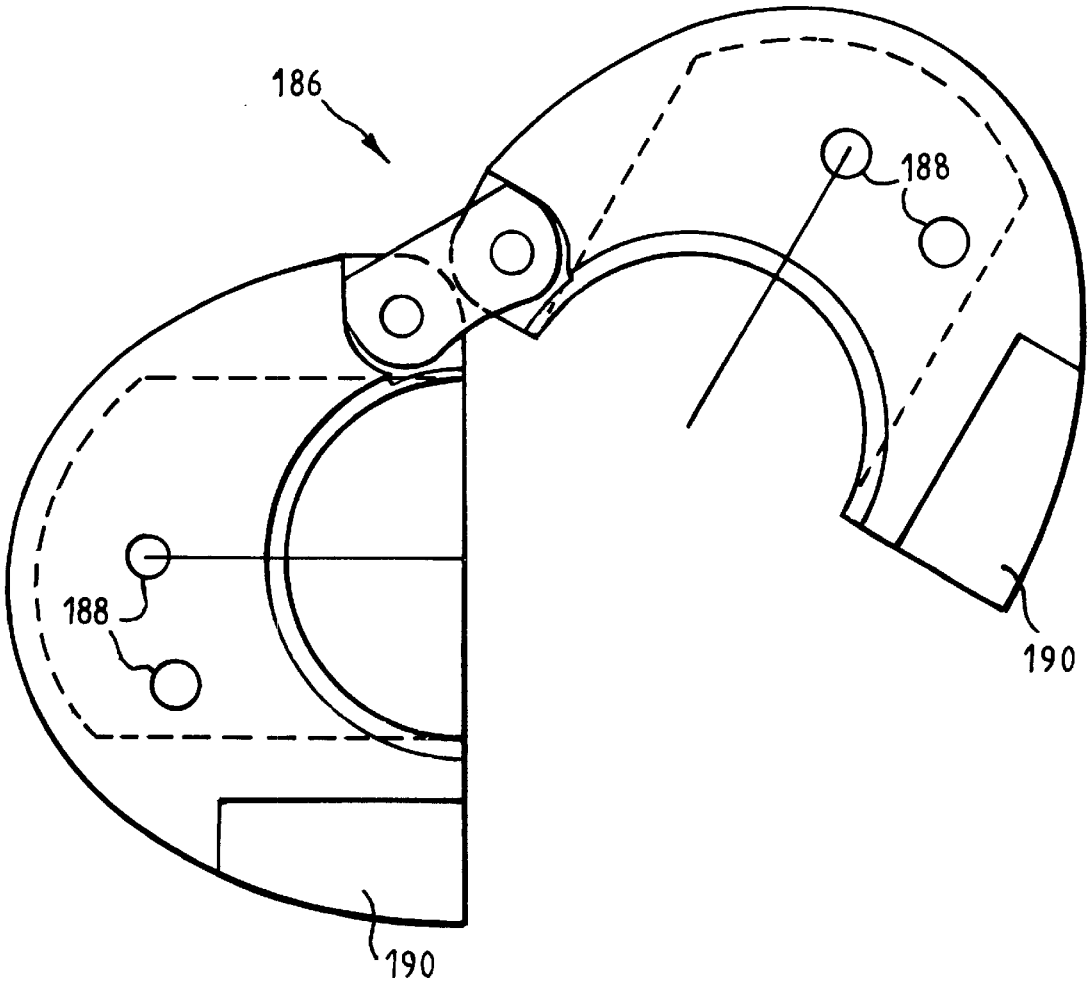
FIG. 14 is a plan view of an elevator in accordance with a still further alternative embodiment of the present invention, shown in an open configuration, with a lock of the elevator removed for clarity, and having holes for coupling lifting eyes to the elevator.

Referring now to FIG. 14, there is shown a plan view of another alternative elevator 186, in accordance with a still further embodiment of the present invention. The elevator 186 includes holes 188 for coupling lifting eyes (not shown), similar to the eyes 16 of the elevator 10 shown in FIG. 1, to the elevator 186. The mounting holes 188 are disposed proximal to a side o the elevator 186 nearest a lock mounting recesses 190 for mounting a lock (not shown). Thus when the elevator 186 is supported by a crane or the like, the elevator 186 is disposed inclined from the vertical, to facilitate discharge of a drill pipe section onto a pipe ramp, whilst maintaining the lock (not shown) away from the ramp.

Various modifications may be made to the foregoing within the scope of the present invention. For example, the elevator may be for use in both tripping out and running-in a tubular member. The elevator may have finger holes to facilitate handling when closing around a tubular member.

The elevator may include an inclined plate, wedge or the like projecting downwardly from the elevator body, or formed peripherally on the elevator. An insert may be provided, enabling the elevator to support pipe of various dimensions. A number of such inserts may be provided to suit the various pipe sizes. The elevator may support elongate members of various cross-sectional shapes, such as square or rectangular cross-section members. The elevator may be constructed in a range of sizes and configurations to suit its use in the safe handling of drill pipe, borehole casing and production tubing, in the drlling and production of oil. It may further be used for handling any manner of tubular material both onshore and offshore.

What is claimed is:

1. An elevator for supporting an elongate member, the elevator comprising a housing having retaining means for retaining an elongate member, and an inclined outer surface having a lower end which is, in use, located such that the inclined outer surface is substantially contiguous with an outer surface of the elongate member, such that the elevator does not become caught on discharge apparatus for the elongate member during handling thereof.

2. An elevator as claimed in claim 1 wherein the housing comprises a ring defining a throughbore.

3. An elevator as claimed in claim 2 wherein the ring comprises at least two sections which together form the ring, and a hinge coupling the sections together, for allowing the ring to open and close.

4. An elevator as claimed in claim 2 wherein the ring is generally elliptical in plan view.

5. An elevator as claimed in claim 2 wherein the ring is generally oval in plan view.

6. An elevator as claimed in claim 2 wherein the ring is generally circular in plan view.

7. An elevator as claimed in claim 2 wherein the ring further comprises an outer wall forming a boundary of the ring, an upper plate extending radially inwardly from the outer wall and defining an upper opening, and a lower plate extending radially inwardly and defining a lower opening.

8. An elevator as claimed in claim 7 wherein the upper opening of the ring is inclined.

9. An elevator as claimed in claim 8 wherein the upper opening defines an abutment surface for abutting the elongate member.

10. An elevator as claimed in claim 9 wherein the inclined abutment surface of the upper opening is adapted to abut a collar of a section of drill pipe.

11. An elevator as claimed in claim 7 wherein the upper and lower openings are circular in cross-section, and offset from a longitudinal axis of the housing.

12. An elevator as claimed in claim 2 wherein the retaining means comprises an inner wall of the ring, defining an abutment surface for abutting the elongate member.

13. An elevator as claimed in claim 1 wherein the inclined outer surface of the elevator is provided on a lower portion thereof.

14. An elevator as claimed in claim 13 wherein the lower portion of the elevator comprises a truncated cone, projecting downwardly from the housing, and tapering from the housing to an opening.

15. An elevator as claimed in claim 14 wherein the opening of the cone defines an abutment surface guiding the elongate member.

16. An elevator as claimed in claim 1 wherein the outer surface of the elevator is of a metal.

17. An elevator as claimed in claim 1 wherein the outer surface of the elevator is of an elastomeric material.

18. An elevator as claimed in claim 1 wherein the inclined outer surface of the elevator is formed peripherally on the elevator.

19. An elevator as claimed in claim 1 wherein an outer wall of the housing comprises the inclined outer surface of the elevator.

20. An elevator as claimed in claim 1 wherein the inclined outer surface of the elevator comprises an inclined plate projecting downwardly from the housing.

21. An elevator as claimed in claim 1 wherein the elevator further comprises locking means for releasably locking the housing to retain the elongate member therein.

22. An elevator as claimed in claim 21 wherein the locking means comprises a latch arm formed on a first half of the housing, and a catch formed on a second half of the housing.

23. An elevator as claimed in claim 22 wherein the latch arm is spring loaded.

24. An elevator as claimed in claim 22 wherein the catch includes a spring loaded cover to releasably retain the latch arm to the catch.

25. An elevator as claimed in claim 1 wherein the elevator further comprises support means for supporting the housing.

26. An elevator as claimed in claim 25 wherein the support means comprises at least one lifting eye provided on the housing for coupling to hoisting means.

27. An elevator as claimed in claim 26 wherein the lifting eye is disposed proximal to a lock side of the elevator.

28. An elevator as claimed in claim 1 wherein the elevator further comprises an insert for coupling to the elongate member enabling the elevator to support elongate members of various cross-sectional dimensions.

29. An elevator as claimed in claim 28 wherein the insert is tubular and adapted for coupling to a pipe.

30. An elevator defining a passage extending therethrough, the passage adapted for receiving and positioning an elongate member relative to the elevator, the elevator having an inclined outer surface which tapers towards a lower end of the elevator, a lower end of the inclined outer surface being inclined to the passage, such that, in use, the inclined outer surface is substantially contiguous with an outer surface of the elongate member received and positioned in the passage, to prevent the elevator from becoming caught on discharge apparatus for the elongate member.

31. An elevator for supporting an elongate member, the elevator comprising a housing having retaining means for retaining an elongate member, and an inclined outer surface having a lower end which is, in use, located such that the inclined outer surface is substantially contiguous with the outer surface of the elongate member.

32. An elevator defining a passage extending therethrough, the passage adapted for receiving and positioning an elongate member relative to the elevator, the elevator having an inclined outer surface which tapers towards a lower end of the elevator, a lower end of the inclined outer surface being inclined to the passage such that, in use, the inclined outer surface is substantially contiguous with an outer surface of the elongate member received and positioned in the passage.

33. An elevator for supporting an elongate member, the elevator comprising a generally elliptical ring defining a throughbore, the ring having retaining means for retaining an elongate member and an inclined outer surface having a lower end which is, in use, adjacent the elongate member, such that the elevator does not become caught on discharge apparatus for the elongate member during handling thereof.

34. An elevator for supporting an elongate member, the elevator comprising a generally oval ring defining a throughbore, the ring having retaining means for retaining an elongate member and an inclined outer surface having a lower end which is, in use, adjacent the elongate member, such that the elevator does not become caught on discharge apparatus for the elongate member during handling thereof.

35. An elevator for supporting an elongate member, the elevator comprising a generally circular ring defining a throughbore, the ring having retaining means for retaining an elongate member and an inclined outer surface having a lower end which is, in use, adjacent the elongate member, such that the elevator does not become caught on discharge apparatus for the elongate member during handling thereof.

36. An elevator for supporting an elongate member, the elevator comprising a ring defining a throughbore, the ring having:

an outer wall forming a boundary of the ring;

an upper plate extending radially inwardly from the outer wall and defining an upper opening;

a lower plate extending radially inwardly and defining a lower opening;

retaining means for retaining an elongate member; and an inclined outer surface having a lower end which is, in use, adjacent the elongate member, such that the elevator does not become caught on discharge apparatus for the elongate member during handling thereof.

37. An elevator for supporting an elongate member, the elevator comprising a ring defining a throughbore, the ring having:

retaining means for retaining an elongate member, the retaining means comprising an inner wall of the ring defining an abutment surface for abutting the elongate member; and an inclined outer surface having a lower end which is, in use, adjacent the elongate member, such that the elevator does not become caught on discharge apparatus for the elongate member during handling thereof.

38. An elevator for supporting an elongate member, the elevator comprising a housing having retaining means for retaining an elongate member, and an inclined outer surface of an elastomeric material having a lower end which is, in use, adjacent the elongate member, such that the elevator does not become caught on discharge apparatus for the elongate member during handling thereof.

39. An elevator for supporting an elongate member, the elevator comprising a housing having:

a first housing half and a second housing half;

retaining means for retaining an elongate member;

an inclined outer surface having a lower end which is, in use, adjacent the elongate member, such that the elevator does not become caught on discharge apparatus for the elongate member during handling thereof; and locking means for releasably locking the housing to retain an elongate member therein, the locking means comprising a latch arm formed on the first half of the housing, and a catch formed on the second half of the housing.

40. An elevator for supporting an elongate member, the elevator comprising a housing having:

retaining means for retaining an elongate member;

an inclined outer surface having a lower end which is, in use, adjacent the elongate member, such that the elevator does not become caught on discharge apparatus for the elongate member during handling thereof; and a tubular insert adapted for coupling to the elongate member enabling the elevator to support elongate members of various cross-sectional dimensions.

* * * * *

UNITED STATES PATENT AND TRADEMARK OFFICE

CERTIFICATE OF CORRECTION

PATENT NO. : 6,494,273 B1
DATED : December 17, 2002
INVENTOR(S) : Richard Martin It is certified that error appears in the above-identified patent and that said Letters Patent is hereby corrected as shown below:

Column 1,
Line 25, delete “pie”, insert -- pipe --;
Line 34, delete “or.”, insert -- on --;
Line 42, delete “to” after “is”;
Line 60, delete “fee”, insert -- vee --;
Line 64, delete “pope”, insert -- pipe --;

Column 2,
Line 66, delete “pine”, insert -- pipe --;

Column 3,
Line 40, delete “clan”, insert -- plan --;
Line 60, delete “D”, insert -- 5 --;

Column 4,
Line 53, delete “86 n”, insert -- 86 in --;

Column 5,
Line 39, after “shown”, insert -- ) --;
Line 59, delete “co”, insert -- to --;

Column 6,
Line 7, delete “he”, insert -- the --;
Line 14, delete “135”, insert -- 136 --;
Line 46, delete “larch”, insert -- latch --;
Line 56, delete “side o”, insert -- side of --;

UNITED STATES PATENT AND TRADEMARK OFFICE

CERTIFICATE OF CORRECTION

PATENT NO. : 6,494,273 B1
DATED : December 17, 2002
INVENTOR(S) : Richard Martin It is certified that error appears in the above-identified patent and that said Letters Patent is hereby corrected as shown below:

Column 7,
Line 42, delete “the”, insert -- an --.

Signed and Sealed this

Nineteenth Day of August, 2003

JAMES E. ROGAN
*Director of the United States Patent and Trademark Office*